US008069926B2

(12) United States Patent
Eddison et al.

(10) Patent No.: US 8,069,926 B2
(45) Date of Patent: Dec. 6, 2011

(54) METHOD OF CONTROLLING FLOW THROUGH A DRILL STRING USING A VALVE POSITIONED THEREIN

(75) Inventors: Alan Martyn Eddison, York (GB); Hazel Farquhar, Aberdeen (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 12/775,716

(22) Filed: May 7, 2010

(65) Prior Publication Data

US 2010/0212912 A1 Aug. 26, 2010

Related U.S. Application Data

(63) Continuation of application No. 11/813,439, filed as application No. PCT/GB2006/000124 on Jan. 16, 2006, now abandoned.

(30) Foreign Application Priority Data

Jan. 14, 2005 (GB) ..... 0500713.3

(51) Int. Cl.
*E21B 34/08* (2006.01)
*E21B 41/00* (2006.01)

(52) U.S. Cl. ..... 166/386; 166/321; 166/374; 175/318; 137/496; 137/512.1

(58) Field of Classification Search ..... 166/321, 166/325, 374, 386, 319, 332.1, 334.1; 175/318; 137/496, 512.1
See application file for complete search history.

(56) References Cited

U.S. PATENT DOCUMENTS

| | | | | | |
|---|---|---|---|---|---|
| 2,268,010 | A | * | 12/1941 | Baum | 166/290 |
| 2,348,047 | A | | 5/1944 | Yost | |
| 2,743,083 | A | | 4/1956 | Zublin | |
| 2,746,721 | A | | 5/1956 | Moore | |
| 2,771,091 | A | * | 11/1956 | Baker et al. | 137/542 |
| 2,781,774 | A | | 2/1957 | Baker et al. | 137/493.2 |
| 2,802,482 | A | * | 8/1957 | Arnhold | 137/315.08 |
| 3,032,111 | A | * | 5/1962 | Corley, Jr. et al. | 166/66.7 |
| 3,051,246 | A | | 8/1962 | Clark, Jr. et al. | 166/226 |
| 3,051,549 | A | | 8/1962 | Clark | |
| 3,385,370 | A | * | 5/1968 | Knox et al. | 166/317 |
| 3,385,372 | A | | 5/1968 | Knox | 166/225 |

(Continued)

FOREIGN PATENT DOCUMENTS

WO WO 01/06086 1/2001

OTHER PUBLICATIONS

UKPTO, Examination Report, Jul. 23, 2009, pp. 1-3, UK.

*Primary Examiner* — Jennifer H Gay
(74) *Attorney, Agent, or Firm* — Jeffery Daly; The JL Salazar Law Firm

(57) ABSTRACT

A downhole valve comprises a tubular body and a valve member. The valve member is normally closed and in the closed position may prevent or restrict passage of a working fluid through the body. The valve member is movable to an open position, a first working fluid pressure differential being necessary to move the valve member from the closed position and a lower second working fluid pressure differential being necessary to maintain the valve member in the open position.

18 Claims, 2 Drawing Sheets

U.S. PATENT DOCUMENTS 3,457,994 A * 7/1969 Stachowiak ..... 166/125
3,640,351 A 2/1972 Coyne et al.
3,894,818 A 7/1975 Tschirky
3,899,033 A 8/1975 Van Huisen
3,933,209 A 1/1976 Sweeney
3,941,196 A 3/1976 Curington et al.
3,965,980 A * 6/1976 Williamson ..... 166/321
3,987,848 A * 10/1976 Canterbury ..... 166/321
4,063,594 A * 12/1977 Canterbury ..... 166/325
4,067,358 A * 1/1978 Streich ..... 137/624.13
4,072,166 A * 2/1978 Tiraspolsky et al. ..... 137/496
4,187,918 A 2/1980 Clark
4,270,569 A * 6/1981 Reay et al. ..... 137/514.7
4,275,795 A 6/1981 Beimgraben et al.
4,280,524 A 7/1981 Beimgraben
4,401,171 A 8/1983 Fuchs
4,481,973 A 11/1984 O'Brien et al. ..... 137/469
4,487,221 A 12/1984 Zwart ..... 137/508
4,615,399 A * 10/1986 Schoeffler ..... 175/38
4,712,619 A * 12/1987 Stepp et al. ..... 166/327
4,729,432 A 3/1988 Helms
4,819,745 A 4/1989 Walter
4,830,122 A 5/1989 Walter
4,953,595 A 9/1990 Kotlyar
4,953,622 A * 9/1990 Lehr et al. ..... 166/327
4,979,577 A 12/1990 Walter
5,009,272 A 4/1991 Walter
5,048,622 A 9/1991 Ide
5,174,392 A 12/1992 Reinhardt
5,190,114 A 3/1993 Walter
5,279,670 A 1/1994 Watanabe et al.
5,320,181 A 6/1994 Lantier, Sr. et al. ..... 166/386
5,411,049 A * 5/1995 Colvard ..... 137/71
5,520,256 A 5/1996 Eddison
5,577,560 A * 11/1996 Coronado et al. ..... 166/387
5,662,180 A 9/1997 Coffman et al.
5,690,177 A * 11/1997 Budde ..... 166/321
5,836,395 A * 11/1998 Budde ..... 166/321
5,850,881 A * 12/1998 Rodger et al. ..... 166/327
5,909,771 A * 6/1999 Giroux et al. ..... 166/120
6,173,784 B1 * 1/2001 Shaposhnikov et al. ..... 166/372
6,279,670 B1 8/2001 Eddison et al.
6,431,294 B1 8/2002 Eddison et al.
6,439,318 B1 8/2002 Eddison et al.
6,508,317 B2 1/2003 Eddison et al.
6,588,518 B2 7/2003 Eddison ..... 175/296
6,622,795 B2 * 9/2003 Hebert et al. ..... 166/374
6,666,273 B2 12/2003 Laurel ..... 166/382
6,820,697 B1 11/2004 Churchhill
6,877,566 B2 4/2005 Selinger et al.
7,086,486 B2 8/2006 Ravensbergen et al.
7,168,493 B2 * 1/2007 Eddison ..... 166/334.4
7,523,792 B2 4/2009 El-Rayes et al.
7,726,418 B2 6/2010 Ayling
7,766,084 B2 8/2010 Churchill
2002/0050359 A1 * 5/2002 Eddison ..... 166/321
2003/0209350 A1 11/2003 Laurel ..... 166/373
2004/0163811 A1 * 8/2004 McKee et al. ..... 166/279
2005/0211471 A1 9/2005 Zupanick
2007/0187112 A1 8/2007 Eddison et al.
2008/0029268 A1 2/2008 Macfarlane
2009/0032261 A1 * 2/2009 Eddison et al. ..... 166/325
2009/0104021 A1 4/2009 Draeger et al.
2010/0044054 A1 * 2/2010 de Boer ..... 166/373
2010/0212912 A1 * 8/2010 Eddison et al. ..... 166/373

* cited by examiner

METHOD OF CONTROLLING FLOW THROUGH A DRILL STRING USING A VALVE POSITIONED THEREIN

CROSS REFERENCE TO RELATED APPLICATIONS

This application is a continuation of U.S. patent application Ser. No. 11/813,439 filed on Sep. 4, 2008, now abandoned which is a United States national stage filing of PCT International Patent Application No. PCT/GB2006/000124 filed on 16 Jan. 2006 which claims priority from GB Application No. 0500713.3 filed 14 Jan. 2005.

FIELD OF THE INVENTION

This invention relates to a valve, and in particular but not exclusively to a downhole valve, and most particularly to a hydrostatic control valve.

BACKGROUND TO THE INVENTION

In the oil and gas exploration and production industry, subsurface hydrocarbon-bearing formations are accessed by drilling bores from surface. In a typical drilling operation a drill bit is mounted on the lower end of a tubular string of pipe extending from surface. Drilling fluid or "mud" is pumped down the drill pipe string from surface and exits through jetting nozzles in the drill bit. The drilling fluid serves a number of purposes, one being to carry drill cuttings out of the bore, that is the drilling fluid entrains the cuttings as the fluid flows back up to surface through the annulus between the drill pipe and the bore wall. On surface the cuttings are separated from the fluid, such that the drilling fluid may be reused or recycled.

The drilling fluid may also be used as a medium to transmit information to surface. In particular, measurement-while-drilling (MWD) tools may be provided in a drill string, which tools include sensors to detect, for example, bore inclination. A transducer in the MWD tool generates a series or cycle of fluid-flow restrictions in the bore of the tool, representative of the sensed inclination of the bore. The restrictions create corresponding pressure pulses in the drilling fluid above the tool. The pressure pulses are detected and analysed on surface, to determine the measured condition.

Problems can be encountered when drilling if lost circulation drilling conditions are encountered; this is when a significant volume of drilling fluid is lost into permeable formations downhole. Thus, the volume of drilling fluid returning to surface is less than that pumped down the bore and on occasion drilling is performed with no returns, that is all the fluid pumped downhole is lost.

A further problem associated with lost circulation occurs when the drilling fluid pumps are stopped; the fluid level in the annulus drops quickly as fluid is lost into the permeable formation and the level of fluid within the drill pipe also drops to equalise the fluid level (known as the U-tube effect). This can create additional difficulties for the operation of MWD tools in such wells as, when the drilling fluid pumps are started again, the drill pipe must be filled with fluid before the MWD tool will start operating and sending signals to surface. If the MWD tool starts operating before the pipe refills the signal is likely to be lost in the air gap. Also, MWD tools can be damaged if they operate in the presence of a mixture of drilling fluid and gas.

SUMMARY OF THE INVENTION

According to the present invention there is provided a valve comprising a tubular body and a valve member. The valve member being normally closed to at least restrict passage of a working fluid through the body, and being movable to an open position to permit passage of fluid through the body. A first working fluid pressure being necessary to move the valve member from the closed position and a lower second working fluid pressure being necessary to maintain the valve member in the open position.

The valve may be adapted for use downhole, in a drilled bore, and is preferably adapted for inclusion in a tubular string, typically a drill string. Thus, in use, the valve may be closed and requires the pressure of the working fluid to be raised to said first pressure to initially open or "crack" the valve. Once the valve is open, and the working fluid is flowing through the body, the lower second pressure will maintain the valve open.

Embodiments of the valve may be useful for maintaining a column of fluid in a tubular string above the valve. The valve may be positioned in a lower portion of the string and when there is no flow of fluid through the string the valve will close, retaining the column of fluid above the valve. To open a valve according to a preferred embodiment of the invention, the fluid pressure above the valve is increased, and once the fluid is flowing through the valve above a predetermined flow rate the pressure will reduce while the valve remains open.

In other embodiments, the closed valve permits flow through the valve. Preferably, the valve member is configured to induce a fluid-flow related force tending to maintain the valve member open. Preferably, the valve member defines a restriction, and flow of the working fluid through the valve member creates a pressure differential across the valve member.

The body may define a valve seat, and the valve seat may define a first area over which fluid pressure acts on the valve member when the valve member is in the closed position. The valve member may comprise a plug portion adapted for cooperating with the valve seat. In the open position the plug portion is preferably spaced from the valve seat, so reducing the pressure drop experienced by fluid flowing over the valve seat and reducing erosion. The plug portion may be elongate, and may have a tapered leading end for cooperating with the valve seat. A collar may define the valve seat. The body may define a larger second area over which a valve-opening fluid pressure may act when the valve member is in the open position, and fluid is flowing through the valve.

The valve member may be biased towards the closed position, preferably by a spring. The valve may be adapted to be retained in the open position. Preferably, the valve is provided in combination with a valve-locking member, which may be utilized to retain the valve member open, preferably by preventing the valve member moving to the closed position. The member may be adapted to be pumped into position. In other embodiments the valve member may be coupled to the body via a cam track and the cam track may define a position in which the valve member is prevented from closing.

According to another aspect of the present invention there is provided a method of retaining a column of fluid in a tubular body, by providing a normally closed valve in a lower portion of a tubular body; flowing fluid through the valve to maintain the valve open, and at least reducing the fluid flow rate to allow the valve to close.

The method may further comprise the step of increasing the fluid pressure above the closed valve to a first pressure to open the valve and permit flow through the valve, and then creating a fluid flow-related pressure differential across the valve to maintain the valve open in the presence of a lower second fluid pressure above the valve. According to a still further aspect of the present invention there is provided a downhole tool having a tubular body, a fluid flow responsive member normally configured in a first configuration and movable to a second configuration, the arrangement being such that the member is movable from the first configuration in response to a first fluid pressure differential across a part of the member while a lower second fluid pressure differential across a part of the member will maintain the member in the second configuration.

The tool may be configured such that, in the first configuration, the tool defines a first flow restriction adapted to create a fluid pressure force over a first area of the member, and the tool defines a second flow restriction adapted to create a fluid pressure force over a larger second area of the member. In the first configuration the first flow restriction may define the minimum flow area through the tool. In the second configuration the second flow restriction may define the minimum flow area through the tool. This may be effected by increasing the area of the first flow restriction as the member moves towards the second configuration. This may be achieved by movement of the member relative to the body, or by relative movement of parts of the member.

The fluid flow responsive member may be a valve member. In the first configuration the valve member may close or restrict fluid flow through the tool.

The flow response member may be operatively associated with another tool or device, such as a bypass tool. Movement of the member may activate, actuate or otherwise reconfigure the other tool or device.

Other preferred and alternative features of this aspect of the invention may coincide with the preferred and alternative features of the first-described aspect, wherein the fluid flow responsive member may include or incorporate the features of the valve member.

According to a still further aspect of the present invention there is provided a method of controlling flow through an elongate tubular body by pumping fluid through a tubular body at a first flow rate, the body comprising a fluid flow responsive member in a first configuration; and then increasing the fluid flow rate to produce a first fluid pressure differential across a first area to create a first actuating force, the first actuating force moving said member towards a second configuration, and with said member in the second configuration fluid flow at a higher second flow rate producing a lower second fluid pressure differential across a larger second area to create a larger second actuating force to maintain the member in the second configuration.

BRIEF DESCRIPTION OF THE DRAWINGS

These and other aspects of the present invention will now be described, by way of example, with reference to the accompanying drawings, in which.

DETAILED DESCRIPTION

Figure 1:
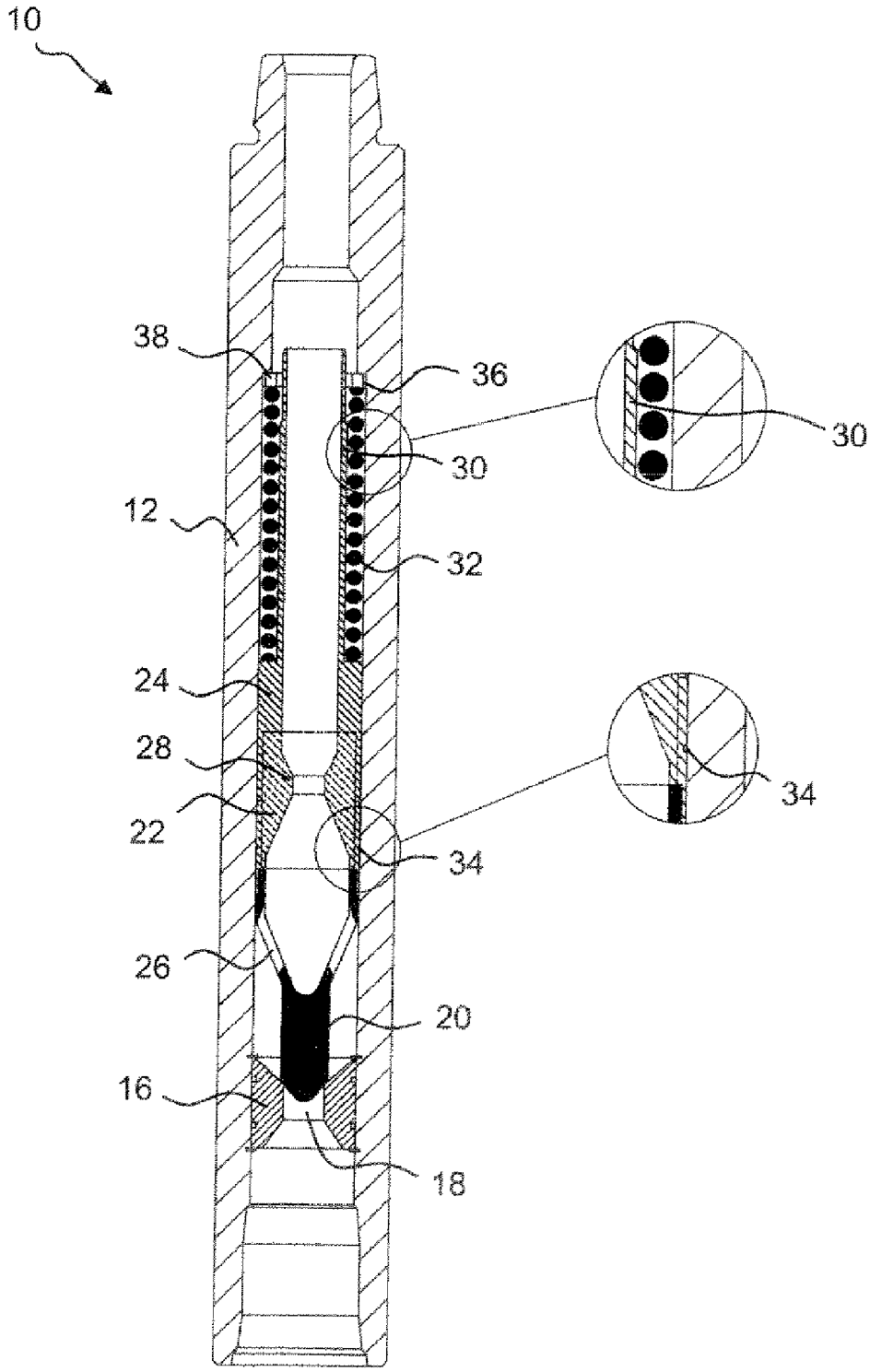
FIG. 1 is a sectional view of a hydrostatic control valve in accordance with a preferred embodiment of the present invention, the valve being illustrated in the closed configuration.

Reference is first made to FIG. 1 of the drawings which illustrates a valve, in the form of a downhole hydrostatic control valve 10, in accordance with a preferred embodiment of the present invention. FIG. 1 illustrates the valve in the closed configuration. The valve 10 comprises a tubular body 12 having ends adapted for coupling to drill pipe sections such that the valve 10 may be incorporated in a string of drill pipe. As will be described, in use the valve 10 is located in the lower end of a drill string and is designed to maintain the drill pipe full of fluid when the drilling fluid pumps are stopped but without an unacceptable increase in circulating pressure at higher flow rates.

Figure 2:
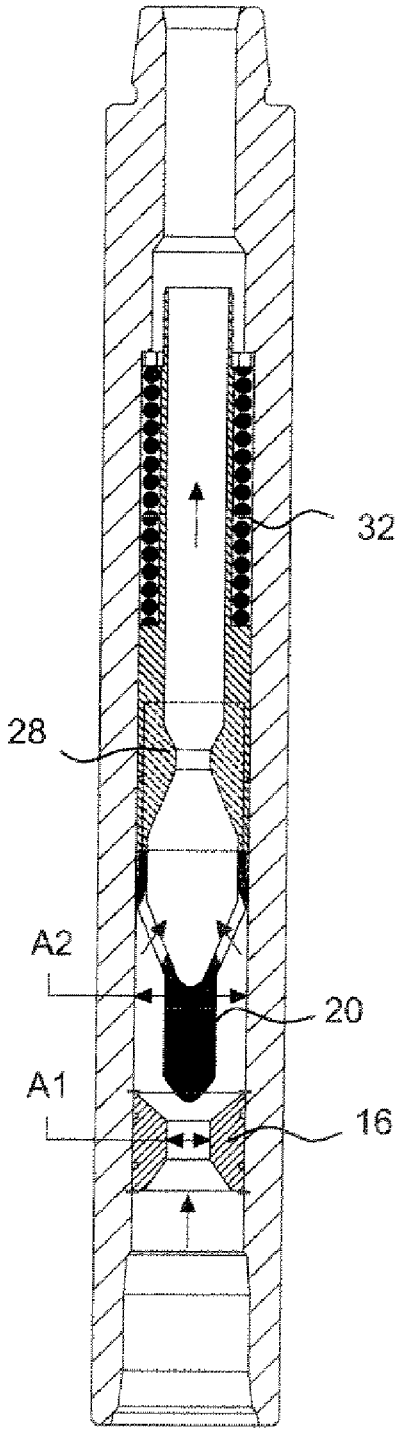
FIG. 2 corresponds to FIG. 1, but shows the valve in the open configuration.

The body 12 contains a fixed valve seat 16 which defines a central through bore 18 of area A1 (FIG. 2). The valve seat 16 cooperates with a valve plug 20 forming part of a valve member 22 which is axially movable within the body 12 to control the opening and closing of the valve 10. The valve member 22 itself comprises a tubular body 24 to which the valve plug 20 is mounted by spaced arms 26, which allow for the free flow of fluid past the plug 20. The body 24 defines a nozzle 28, followed by a tubular sleeve 30 around which is mounted a coil spring 32 which tends to bias the valve member 22 towards the closed position. The valve member body 24 carries O-ring seals 34 which provide a sliding seal with the inner wall of the body 12. Accordingly, any differential fluid pressure created by flow through the nozzle 28 acts across the cross-sectional area of the valve body 24, area A2 (FIG. 2), which area is significantly larger than area A1.

The collar 36 supporting the lower end of the spring 32 forms the lower end of a spring chamber and defines fluid ports 38. To provide damping for the valve member the ports 38 may be relatively small, to restrict the flow of fluid into and from the spring chamber.

When there is no flow and the valve 10 is closed (FIG. 1) the valve plug 20 is held against the valve seat 16 by the spring 32. When flow is started the static fluid pressure required to begin opening the valve is the force from the spring 32 divided by the area A1, which pressure is supplied from the surface drilling fluid pumps. However, when flow is established and increased to higher rates there is also a pressure differential produced across the nozzle 28. This pressure acts on area A2 which, as noted above, is significantly larger than area A1, and at a threshold flow rate the force produced by the pressure differential across the nozzle 28 acting on area A2 will exceed the force produced by the fluid pressure differential across the valve plug 20 acting on area A1. At this point the valve closing spring 32 will be further compressed and the valve plug 20 is moved away from the valve seat 16. This will tend to reduce the pressure drop and fluid velocity between the valve plug 20 and the valve seat 14, thus preventing fluid erosion damage in this area and reducing the pressure required to keep the valve open. The pressure losses induced by the valve are also reduced, particularly as the flow rate of fluid through the valve 10 is increased.

When the flow rate is subsequently reduced below the threshold level the valve plug 20 will again be forced towards the valve seat 16 and the pressure drop across the tool will increase. When the flow is stopped the valve plug 20 will contact the valve seat 16 preventing any further flow and maintaining the drill pipe above the valve 10 full of drilling fluid.

Typical values for a valve in accordance with this embodiment of the invention are as follows:

Tool size (o.d.): 8"
Valve opening pressure: 1,500 psi
Threshold flow rate: 800 gpm
Pressure drop across valve @ 1,200 gpm: 550 psi Thus it is apparent that a relatively high fluid pressure (1,500 psi) is required to open the valve 10, but that once fluid is flowing through the valve 10 at a predetermined rate, in this case 800 gpm, the valve 10 will remain open even if the upstream pressure of the fluid falls below the opening pressure; the flow of fluid through the nozzle 28 creates a pressure differential which acts across a relatively large area A2 and serves to retain the valve open. As is apparent from the above-noted figures, the relatively large area A2 allows the pressure drop across the valve 10 to be kept to a low level at operating flow rates.

Figure 3:
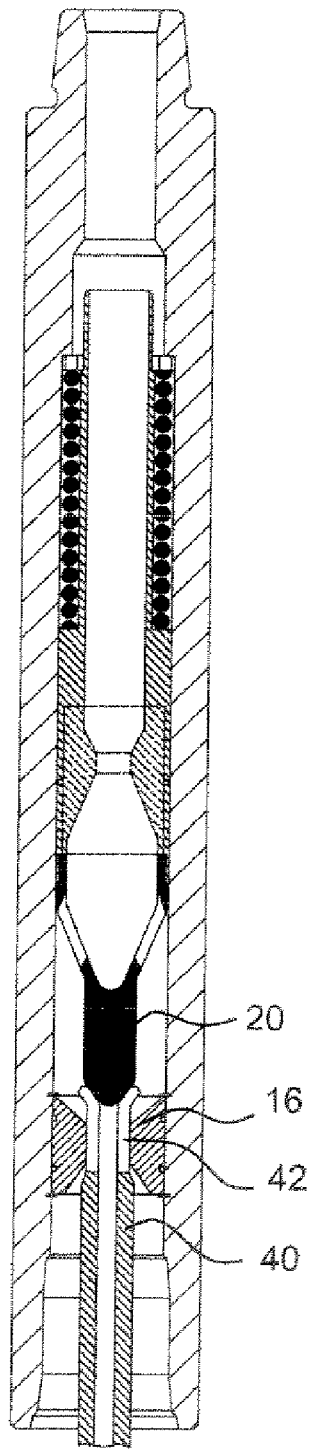
FIG. 3 corresponds to FIG. 1, and shows the valve in being held in the open configuration.

A potential disadvantage of such a hydraulic control valve 10 is that when pulling out of hole the valve 10 will be closed and the drill pipe will remain full of drilling fluid. This is inconvenient because when each stand of drill pipe is disconnected at surface a significant amount of drilling fluid is released onto the rig floor. This fluid normally must be contained and returned to the drilling fluid system, which can be time consuming and costly. To avoid this difficulty, the valve may be maintained in the open position, and one example of how this could be achieved is illustrated in FIG. 3 of the drawings. Prior to pulling out, a spring collet dart 40 is pumped down from surface, the spring fingers 42 of the dart being deformable such that the fingers 42 can squeeze through the valve seat 16. Once through the valve seat 16, the fingers 42 spring open and the dart 40 rests on the end of the valve plug 20. When the flow is stopped it is not possible for the collet to pass back through the valve seat 16 because the valve plug 20 traps the fingers 42. This prevents the valve 10 from sealing and allows drilling fluid to drain through the valve 10, such that the drill pipe is empty when pulling out of hole.

In use, the valve 10 may be located in a drill string adjacent an MWD tool. In normal operation, the valve 10 will be kept open by the flow of drilling fluid through the string. If lost circulation conditions are encountered, and the drilling fluid pumps are stopped, the flow of drilling fluid through the valve 10 will cease and the valve 10 will close. Thus, the column of drilling fluid in the drill string above the valve 10 is retained, even if the fluid level in the annulus drops, as fluid is lost into the permeable formation. When the pumps are restarted, the pressure in the drill string above the valve rises until reaching a level sufficient to open the valve 10. The fluid then flows through the valve 10 and soon reaches the level required to maintain the valve 10 open. During this period, the MWD tool will have remained filled with fluid, and there will be a continuous column of fluid above the MWD tool, ensuring proper operation of the tool and providing for transmission of signals from the MWD tool to surface.

The valve 10 as described above may also be utilised in other applications, or modified forms of the valve may be utilised, as described below.

In the above-described application the valve 10 prevents flow when in the closed configuration. However, valves or tools in accordance with other aspects of the invention may be configured to permit flow in the first or "closed" configuration. With reference to the illustrated embodiment, this could be achieved by, for example, providing ports extending through the valve seat 16, or by changing the form of the plug 20 such that at least the upper end of the plug 20 is of smaller diameter than the seat 16 and an open annulus remains between the plug 20 and seat 16. In this configuration, fluid may be pumped through the closed valve 10 and thus circulated through a pipe string. However, if it is desired to circulate or pump fluid at a relatively high rate, with lower pressure losses, this may be achieved by opening the valve 10. Of course this may be accomplished quickly and easily merely by increasing the pump rate.

In other embodiments the valve member 22 may also be coupled to other tools or devices and the movement of the valve member 22 utilised to activate, actuate or reconfigure another tool or device. In one embodiment the movement of the valve member 22 may open and close a bypass port, as described below, and may be useful, for example, in fracture acidising operations.

For an acidizing application such as this the valve 10 may be configured to permit flow when the valve is in the first configuration and may be mounted to coiled tubing above an agitator, such as applicant's AG-itator tool. The valve member 22 is coupled to a bypass tool provided between the valve 10 and the agitator, the bypass tool being normally closed. The bypass tool is also of the form which, when the side ports are open, the axial passage through the tool providing fluid access to the agitator is closed.

As the coiled tubing is run into the bore, fluid is circulated through the tubing to actuate the agitator, the vibration produced by the agitator assisting in advancing the tubing through the bore. The fluid flow rate and fluid pressure necessary to operate the agitator is relatively low and during the running-in phase of the operation the valve 10 remains in the "closed" configuration, as do the side ports of the bypass tool.

When the bypass tool is located adjacent the formation to be fractured, acid is pumped from surface at a high pressure and flow rate through the coiled tubing. There will be an initial resistance to the higher flow rate from the initially closed valve 10. However, as the flow rate through the valve 10 increases the pressure differential induced by the nozzle 28 and acting across the whole area of the valve body 24 will increase and the valve 10 will open. Thus, as the plug 20 is moved away from the seat 16 the pressure drop across the valve 10 will decrease as the flow rate increases. Simultaneously, the side ports of the bypass tool will open, and the further flow of fluid into and through the agitator will be prevented.

The acid being pumped down through the coiled tubing will thus pass through the open valve 10 and then pass through the side ports of the bypass tool into the formation. The actuation of the bypass tool also protects the agitator from the potentially damaging effects of the acid, and from the elevated flow which could create a pressure differential across the agitator sufficient to damage the agitator.

It will be apparent to those of skill in the art that the above-described embodiments are merely exemplary of the present invention, and that various modifications and improvements may be made thereto, without departing from the scope of the invention.

For example, a number of alternative mechanisms could be used to lock the valve 10 open for pulling out of hole. Furthermore, to damp movement of the valve member 22 and to prevent or limit vibration when the valve is opening, the valve may include a dashpot-type damping mechanism.

The invention claimed is:

1. A method of retaining a column of fluid in a tubular body, the method comprising:

providing a fluid flow-responsive member comprising a sleeve having a normally closed valve at an end thereof axially moveable within the tubular body and having a nozzle therein acting across a cross-sectional area thereof, the normally closed valve scatable in a valve scat of the tubular body, the fluid flow-responsive member in a first configuration to only partially restrict passage of a working fluid through a central bore in the normally closed valve in a portion of the tubular body;

increasing a first fluid pressure differential across a first area in the tubular body to create a first actuating force, the first actuating force moving said fluid flow-responsive member towards a second configuration;

flowing fluid through the valve seat to maintain the valve open; and reducing the fluid flow rate to allow the valve to close and retain a column of fluid thereabove.

2. The method of claim 1 further comprising the step of maintaining the fluid flow-related pressure differential by the reduction of the fluid flow rate.

3. The method of claim 1, further comprising maintaining the valve open by positioning a collet dart against the normally closed valve.

4. A method of controlling flow through an elongate tubular body in a drill string, the method comprising:

providing a fluid flow-responsive member comprising a sleeve having a normally closed valve at an end thereof axially moveable within the tubular body and having a nozzle therein acting across a cross-sectional area thereof, the normally closed valve seatable in a valve seat of the tubular body, the fluid flow-responsive member in a first configuration to only partially restrict passage of a working fluid through a central bore in the normally closed valve in a portion of the tubular body;

pumping the working fluid through the tubular body at a first flow rate to establish a first fluid pressure differential across a first area in the tubular body to create a first actuating force on the fluid flow-responsive member within the body; and increasing the first fluid pressure differential across the first area which produces a second fluid pressure differential to create a first actuating force, the first actuating force moving said fluid flow-responsive member towards a second configuration having a second, larger area thereby creating a larger, second actuating force on the fluid flow-responsive member within the body, and with said fluid flow-responsive member in the second configuration, pumping the fluid at a lower second flow rate producing a third fluid pressure differential intermediate the first and second fluid pressure differentials while maintaining the fluid flow-responsive member in the second configuration.

5. The method of claim 4 wherein the fluid flow-responsive member comprises a valve positioned in a portion of the drill string and when there is no flow of fluid through the string, the valve closes, retaining a column of fluid above the valve.

6. The method of claim 5 wherein to re-open the valve, the fluid pressure above the valve is increased, and once the fluid is flowing through the valve above a predetermined flow rate, the third fluid pressure differential reduces while the valve remains open.

7. The method of claim 5 wherein the valve seat defines the first area over which fluid pressure acts on the valve when the valve is in the closed position.

8. The method of claim 6 wherein, when flow is established and increased to higher rates a pressure differential is produced across the valve seat which forms the first area.

9. The method of claim 4 further comprising maintaining the first fluid pressure differential by the reduction of the fluid flow rate.

10. The method of claim 4, further comprising maintaining the valve open by positioning a collet dart against the normally closed valve.

11. A method of controlling flow through an elongate tubular body in a drill string the method comprising:

providing a fluid flow-responsive member comprising a sleeve having a normally closed valve at an end thereof axially moveable within the tubular body and a nozzle therein, the normally closed valve seatable in a valve seat of the tubular body, the fluid flow-responsive member in a first configuration to only partially restrict passage of a working fluid through a central bore in the normally closed valve in a portion of the tubular body; and establishing a pressure differential caused by a flow acting on a first area, A1, which is significantly smaller than a second area, A2, increasing the fluid pressure differential across the first area, A1 to create a first actuating force at a threshold flow rate, causing a first force produced by the pressure differential across the nozzle acting on area A2 which exceeds a second force produced by the fluid pressure differential across the valve of the fluid flow-responsive member acting on the valve seat with the area A1, thereby further compressing a valve closing spring and moving the valve away from the valve scat, thereby reducing the pressure drop and fluid velocity between the valve and the valve seat, thereby preventing fluid erosion damage and also reducing the pressure differential required to keep the valve open.

12. The method of claim 11 wherein the fluid flow-responsive member activated by the pressure differential is operatively associated with another tool or device and wherein the method comprises movement of the member to activate another tool or device.

13. The method of claim 11 wherein the fluid flow-responsive member activated by the pressure differential is operatively associated with another tool or device and wherein the method comprises movement of the member to actuate another tool or device and further comprising the step of maintaining the fluid flow-related pressure differential by the reduction of the fluid flow rate.

14. The method of claim 11 wherein the fluid flow-responsive member activated by the pressure differential is operatively associated with another tool or device and wherein the method comprises movement of the member to reconfigure another tool or device wherein the valve is positioned in a portion of the drill string and when there is no flow of fluid through the string, the valve closes, retaining a column of fluid above the valve.

15. The method of claim 11, further comprising maintaining the valve open by positioning a collet dart against the normally closed valve.

16. A method of controlling flow through an elongate tubular body in a drill string, the method comprising providing a fluid flow-responsive member comprising a sleeve having a normally closed valve at an end thereof axially moveable within the tubular body and a nozzle therein acting across a cross-sectional area thereof, the normally closed valve seatable in a valve seat of the tubular body, the fluid flow-responsive member in a first configuration to only partially restrict passage of a working fluid through a central bore in the normally closed valve in a portion of the tubular body; and pumping a fluid through the tubular body at a first flow rate and providing an actuating force, the actuating force being insufficient to move said fluid flow-responsive member towards a second configuration, thereby causing a vibration of the fluid flow-responsive member when the fluid is flowing, thereby producing pressure pulses in the fluid.

17. The method of claim 16 further comprising a dashpot type damping mechanism to damp movement of the fluid flow-responsive valve member to prevent or limit vibration when the valve is opening.

18. The method of claim 16, further comprising maintaining the valve open by positioning a collet dart against the normally closed valve.

* * * * *